US007815756B2

(12) United States Patent
Kawasaki et al.

(10) Patent No.: US 7,815,756 B2
(45) Date of Patent: Oct. 19, 2010

(54) BUILD-UP WEAR-RESISTANT COPPER-BASED ALLOY

(75) Inventors: Minoru Kawasaki, Toyota (JP); Tadashi Oshima, Aichi-ken (JP); Takao Kobayashi, Seto (JP); Kazuyuki Nakanishi, Seto (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 230 days.

(21) Appl. No.: 11/521,335

(22) Filed: Sep. 15, 2006

(65) Prior Publication Data

US 2007/0065331 A1 Mar. 22, 2007

Related U.S. Application Data

(63) Continuation of application No. PCT/JP2005/001452, filed on Jan. 26, 2005.

(30) Foreign Application Priority Data

Mar. 15, 2004 (JP) ..... 2004-072979

(51) Int. Cl.
*C22C 9/06* (2006.01)

(52) U.S. Cl. ..... 148/414; 148/435; 420/487; 420/488; 420/490

(58) Field of Classification Search ..... 148/412–414, 148/433–435; 420/473, 481, 487, 488, 490
See application file for complete search history.

(56) References Cited

U.S. PATENT DOCUMENTS 3,224,875 A 12/1965 Buehler et al.
3,293,029 A 12/1966 Broderick et al.
5,004,581 A * 4/1991 Takagi et al. ..... 420/487
5,188,799 A 2/1993 Mori et al.
5,843,243 A 12/1998 Kawasaki et al.
5,911,949 A 6/1999 Ninomiya et al.
6,096,142 A 8/2000 Kano et al.

FOREIGN PATENT DOCUMENTS

EP 0 320 195 A 6/1989
EP 1 120 472 A 8/2001
GB 569 408 A 5/1945
GB 577 170 A 5/1946
GB 2 157 318 A 10/1985
JP 01-152232 6/1989

(Continued)

OTHER PUBLICATIONS

European Search Report dated Apr. 29, 2009, PCT/JP2005001452.

*Primary Examiner*—Sikyin Ip
(74) *Attorney, Agent, or Firm*—Finnegan, Henderson, Farabow, Garrett & Dunner, LLP

(57) ABSTRACT

This is to provide a build-up wear-resistant copper-based alloy, which is advantageous for enhancing the cracking resistance and machinability, which is appropriate for cases of building up to form built-up layers especially, and which is equipped with the wear resistance, cracking resistance and machinability combinedly in a well balanced manner. A build-up wear-resistant copper-based alloy is characterized in that it has a composition, which includes nickel: 5.0-20.0%; silicon: 0.5-5.0%; manganese: 3.0-30.0%; and an element, which combines with manganese to form a Laves phase and additionally to form silicide: 3.0-30.0%; by weight %, and inevitable impurities; and additionally the balance being copper. The element can be one member or two or more members of titanium, hafnium, zirconium, vanadium, niobium and tantalum.

9 Claims, 5 Drawing Sheets

FOREIGN PATENT DOCUMENTS

| | | |
|---|---|---|
| JP | 01-215941 | 8/1989 |
| JP | 2-24637 | 5/1990 |
| JP | 2-58444 | 12/1990 |
| JP | 05-140678 | 6/1993 |
| JP | 6-98506 | 12/1994 |
| JP | 7-17978 | 3/1995 |
| JP | 8-225868 | 9/1996 |
| JP | 10-158766 | 6/1998 |
| JP | 11-310837 | * 11/1999 |

* cited by examiner

BUILD-UP WEAR-RESISTANT COPPER-BASED ALLOY

This is a continuation of PCT application PCT/JP2005/001452 filed Jan. 26, 2005, which in turn is based on Japanese application 2004-72979 filed Mar. 15, 2004, the entire contents of each of which is incorporated herein by reference.

TECHNICAL FIELD

The present invention relates to a build-up wear-resistant copper-based alloy. The present invention, for instance, can be applied to sliding materials.

BACKGROUND ART

Conventionally, as build-up wear-resistant copper-based alloys, alloys in which beryllium is added to copper; a copper-nickel-silicon alloy known as the Colson alloy; and dispersion-strengthened type alloys in which hard oxide particles, such as $SiO_2$, $Cr_2O_3$ and BeO, are dispersed in copper-based matrices have been known. However, these alloys are such that they are associated with the problem of adhesion, and that the wear resistance does not necessarily have a sufficient characteristic.

Hence, the present applicant developed a build-up wear-resistant copper-based alloy containing zinc or tin, which is more likely to be oxidized than copper. In this one, the adhesion resistance is upgraded by means of the generation of the oxides of zincortin, and the wear resistance of the copper-based alloy improves. However, since zinc or tin is such that the melting point is remarkably lower than copper, it is not necessarily a satisfactory one. Especially, in forming the build-up layers of the aforementioned copper-based alloy using a high-density energy thermal source, such as a laser beam, zinc or tin is likely to evaporate in building up, it has not been easy to maintain the target concentrations of alloying elements. Hence, recently, a build-up wear-resistant copper-based alloy having a composition, which includes nickel: 10.0-30.0%; silicon: 0.5-5.0%; iron: 2.0-15.0%; chromium: 1.0-10.0%; and cobalt: 2.0-15.0%; as well as one member or two or more members of molybdenum, tungsten, niobium and vanadium: 2.0-15.0%; by weight %, has been developed by the present applicant (Patent Literature No. 1, and Patent Literature No. 2). In this alloy, hard particles having Co—Mo system silicides (silicified substances), and Cu—Ni system matrices are the major ingredients. The wear resistance of this build-up wear-resistance copper-based alloy is secured mainly by the hard particles having Co—Mo system silicides, and the cracking resistance of this build-up wear-resistance copper-based alloy is secured mainly by the Cu—Ni system matrices. Even when this alloy is used under severe conditions, the wear resistance is high. Further, since zinc and tin are not used as an active element, the drawback of the evaporation of alloying elements is less even in the case of building up, and the occurrence of fuming, and the like, is less. Accordingly, it is appropriate for alloys for building up, alloys which form build-up layers using a high-density energy thermal source, such as a laser beam, especially.

As described above, even if alloys according to Patent Literature No. 3 and Patent Literature No. 4 are used under severe conditions, they exhibit good wear resistance. Especially, in oxidizing atmospheres or in air, since oxides, which exhibit satisfactory solid lubricating properties, generate, they exhibit good wear resistance.

Patent Literature No. 1: Japanese Unexamined Patent Publication (KOKAI) No. 8-225,868

Patent Literature No. 2: Japanese Examined Patent Publication (KOKOKU) No. 7-17,978

Patent Literature No. 3: Japanese Unexamined Patent Publication (KOKAI) No. 8-225,868

Patent Literature No. 4: Japanese Examined Patent Publication (KOKOKU) No. 7-17,978

DISCLOSURE OF THE INVENTION

However, although the aforementioned Co—Mo system silicides have the wear-resistance upgrading effect, they are hard and brittle so that, when adjusting the alloy compositions in the direction of enhancing the a real ratio of hard particles, the cracking resistance of the build-up wear-resistant copper-based alloy degrades. Especially, in the case where the build-up wear-resistant copper-based alloy is built up, bead cracks might occur, and accordingly the building-up yield ratio degrades. Further, the machinability is likely to degrade. On the contrary, when adjusting the alloy compositions in the build-up wear-resistant copper-based alloy in the direction of lowering the areal ratio of hard particles, the wear resistance of the build-up wear-resistant copper-based alloy degrades.

Recently, the aforementioned build-up wear-resistant copper-based alloy is about to be employed in various environments, and besides the service conditions are about to become much harsher. Hence, it has been required that it can demonstrate good wear resistance even in various environments. Accordingly, in industries, alloys have been desired, alloys which are equipped with wear resistance, cracking resistance and machinability combinedly in a better balanced manner than the alloys according to the aforementioned gazettes.

The present invention has been done in view of the aforementioned circumstances, and it is an assignment to provide a build-up wear-resistant copper-based alloy, which can not only enhance the wear resistance in high-temperature regions, which is but also advantageous for enhancing the cracking resistance and machinablity, which is appropriate for cases of building up to form built-up layers especially, and which is equipped with the wear resistance, cracking resistance and machinability combinedly in a well balanced manner.

The present inventors, under the aforementioned assignment, devoted themselves to advancing the development, and focused their attention on the fact that the Co—Mo system silicides, the major ingredients of the hard particles, have a property of being hard and brittle; and can make a starting points of cracking. And, the present inventors acknowledged the fact that, by means of decreasing the cobalt content and increasing the molybdenum content instead, it is possible to decrease or vanish the Co—Mo system silicides, which have a property of being hard and brittle, and additionally to increase the proportion of Fe—Mo system silicides, which are provided with such a property that the hardness is lower and the toughness is also slightly higher than the Co—Mo system silicides, by means of this, they developed recently a build-up wear-resistant copper-based alloy which can not only enhance the wear resistance in high-temperature regions but also can enhance the cracking resistance and machinability in a well balanced manner.

The present invention has further improved the aforementioned build-up wear-resistance copper-based alloy, and they acknowledged the facts that, when cobalt, iron and molybdenum, which form the Co—Mo system silicides and Fe—Mo system silicides, are not contained as an active element; and manganese substitutes for cobalt, iron and molybdenum; further, when an element (for example, titanium, hafnium, zirconium, vanadium, niobium, tantalum, and the like), which combines with manganese to form a Laves phase and additionally to form silicide, is contained, it is possible to decrease or vanish the Co—Mo system silicides and Fe—Mo system silicides and additionally to increase Mn system silicides, thereby making it possible to provide a build-up wear-resistant copper-based alloy, to which toughness can be given; which can furthermore improve the cracking resistance (cladding property) during building up; which can make the cracking resistance and wear resistance furthermore compatible in a well balanced manner; and further which can improve the machinability: and they confirmed them by tests. Based on such an acknowledgement, they have developed a build-up wear-resistance copper-based alloy according to a first invention.

Further, when one member or two or more members of titanium carbide, molybdenum carbide, tungsten carbide, chromium carbide, vanadium carbide, tantalum carbide, niobium carbide, zirconium carbide and hafnium carbide are contained in an amount of 0.01-10.0% in a build-up wear-resistant copper-based alloy according to a first invention, they acknowledged that it is possible to furthermore enhance the wear resistance, cracking resistance and machinability in high-temperature regions, based on such an acknowledgement, they have developed a build-up wear-resistance copper-based alloy according to a second invention.

Namely, a build-up wear-resistant copper-based alloy according to a first invention is characterized in that it has a composition, which includes nickel: 5.0-20.0%; silicon: 0.5-5.0%; manganese: 3.0-30.0%; and an element, which combines with manganese to form a Laves phase and additionally to form silicide: 3.0-30.0%; by weight %, and inevitable impurities; and additionally the balance being copper, and it is free from cobalt, iron and molybdenum as an active element.

As for an element, which combines with manganese to form a Laves phase and additionally to form silicide, it is possible to exemplify one member or two or more members of titanium, hafnium, zirconium, vanadium, niobium and tantalum.

A build-up wear-resistant copper-based alloy according to a second invention is characterized in that, in addition to the build-up wear-resistant copper-based alloy according to the first invention, it contains one member or two or more members of titanium carbide, molybdenum carbide, tungsten carbide, chromium carbide, vanadium carbide, tantalum carbide, niobium carbide, zirconium carbide and hafnium carbide: 0.01-10.0% by weight %. These carbides carry out the nucleation action of hard particles, and disperse in alloys finely. They furthermore improve the wear resistance and cladding property, and improve the machinability as well.

In the present description, % means weight %, unless otherwise stated. Copper-based alloys are alloys in which the weight % of copper, the balance obtained by subtracting the total amount of the additive elements from 100 weight %, surpasses the independent weight % of the respective additive elements.

EFFECT OF THE INVENTION

In accordance with the build-up wear-resistance copper-based alloys according to the first invention and second invention, since the Co—Mo system silicides and Fe—Mo system silicides can be decreased or vanished, and additionally Mn system silicides are generated actively, they are advantageous for enhancing the cracking resistance (cladding property) and machinability, and the wear resistance in high-temperature regions can be secured. Therefore, it is possible to satisfy the cracking resistance, machinability and wear resistance in a well balanced manner. Especially, as shown with data on later-described examples, it is possible to improve the cracking resistance.

BEST MODE FOR CARRYING OUT THE INVENTION

Figure 1:
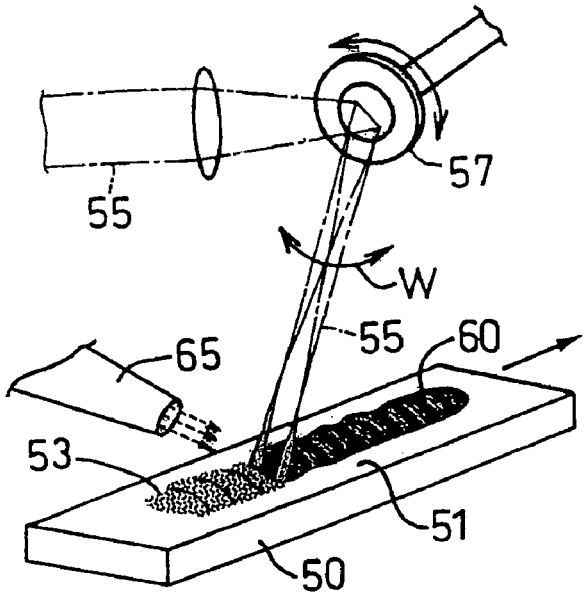
FIG. 1 is a perspective diagram for schematically illustrating a state in which a built-up layer is formed by means of irradiating a sample layer, which is formed of a build-up wear-resistant copper-based layer, with a laser beam.

In accordance with the build-up wear-resistant copper-based alloys according to the first invention and second invention, a structure in which hard particles, which have hard phases, are dispersed in a matrix is obtained generally. As for a representative matrix of the build-up wear-resistant copper-based alloys, it is possible to employ a mode which is formed of a Cu—Ni system solid solution, and silicide whose major component is nickel, as the major ingredients.

The average hardness of the hard particles is higher than the average hardness of the matrix. The hard particles can employ such a mode that includes silicide (silicified substances). In addition to the hard particles, the matrix as well can employ such a mode that includes silicide (silicified substances).

Here, as for the hard particles, it is possible to employ such a mode that includes silicide (silicified substances) whose major component is one member or two or more members of titanium, hafnium, zirconium, vanadium, niobium and tantalum.

In accordance with the build-up wear-resistant copper-based alloy according to the present invention, as for the average hardness (micro Vickers) of the matrix in which the hard particles are dispersed, it can be Hv 130-260 approximately, especially, Hv 150-220 or Hv 160-200, generally; as for the average hardness of the hard particles, it is harder than the matrix, and can be Hv 250-1000 approximately, especially, Hv 300-800. The volumetric ratio of the hard particles is selected properly, however, it is possible to exemplify 5-70% approximately, 10-60% approximately, 12-55% approximately, by volumetric ratio, for instance, among 100% when the build-up wear-resistant copper-based alloy is taken as 100%. The particle diameters of the hard particles are affected by the composition of the build-up wear-resistant copper-based alloy, the solidifying rate of the build-up wear-resistant copper-based alloy, and the like, as well, however, they can be 5-3,000 μm, 10-2,000 μm, or 40-600 μm, further, they can be 50-500 μm, or 50-200 μm, however, they cannot be limited to this.

Explanations on the limiting reasons for the composition according to the build-up wear-resistant copper-based alloy according to the present invention will be added.

Nickel: 5.0-20.0%

Nickel is such that a part thereof is solved into copper to enhance the toughness of copper-based matrix; and that another part thereof forms hard silicide (silicified substances), whose major component is nickel, to enhance the wear resistance by means of dispersion strengthening. When it is less than the lower limit value of the aforementioned content, the characteristics, which copper-nickel system alloys have, especially, the favorable corrosion resistance, heat resistance and wear resistance, become less likely to be demonstrated, further, the hard particles decrease, so that the aforementioned effects are not obtained sufficiently. When it exceeds the upper limit value of the aforementioned content, the hard particles become excessive, the toughness lowers so that cracks become likely to occur when it is turned into built-up layers; in the case of further building it up, the building-up property with respect to physical objects, building-up mating members, degrades. Considering the aforementioned circumstances, nickel is 5.0-20.0%. Nickel, for instance, can be 5.3-18%, especially, 5.5-17.0%. Note that, depending on the degree of attaching importance to various properties required for the build-up wear-resistant copper-based alloy according to the present invention, as for the lower limit value of the aforementioned content range of nickel, it is possible to exemplify 5.2%, 5.5%, 6.0%, 6.5%, or 7.0%; and, as for the upper limit value, which corresponds to the lower limit value, for example, it is possible to exemplify 19.5%, 19.0%, 18.5%, or 18.0%; however, they are not limited to these.

Silicon: 0.5-5.0%

Silicon is an element, which forms silicide (silicified substances), and forms silicide whose major component is nickel, or silicide whose major component is titanium, hafnium, zirconium, vanadium, niobium or tantalum, further, it contributes to the strengthening of copper-based matrix. When it is less than the lower limit value of the aforementioned content, the aforementioned effects are not obtained sufficiently. When it exceeds the upper limit value of the aforementioned content, the toughness of build-up wear-resistant copper-based alloy degrades so that cracks become likely to occur when it is turned into built-up layers and the building-up property with respect to physical objects degrades. Considering the aforementioned circumstances, silicon is 0.5-5.0%. For example, silicon can be 1.0-4.0%, especially, 1.5-3.0% or 1.6-2.5%. Depending on the degree of attaching importance to various properties required for the build-up wear-resistant copper-based alloy according to the present invention, as for the lower limit value of the aforementioned content range of silicon, it is possible to exemplify 0.55%, 0.6%, 0.65%, or 0.7%; and, as for the upper limit value, which corresponds to the lower limit value, it is possible to exemplify 4.5%, 4.0%, 3.8%, or 3.0%; however, they are not limited to these.

Manganese: 3.0-30.%

Manganese forms a Laves phase, and additionally generates silicide, and works to stabilize silicide. Moreover, manganese is such that a tendency of improving the toughness is perceived. When it is less than the lower limit value of the aforementioned content, the fear of not obtaining the aforementioned effects sufficiently is highly likely. When it exceeds the upper limit value of the aforementioned content, the coarsening of the hard phases becomes violent, and the mating-member aggressiveness becomes likely to heighten so that the toughness of build-up wear-resistant copper-based alloy degrades; further, in the case of building it up on physical objects, cracks become likely to occur. Considering the aforementioned circumstances, manganese is 3.0-30.%. For example, manganese is such that it is possible to exemplify3.2-28.0%, 3.3-25%, or 3.5-23%. Depending on the degree of attaching importance to various properties required for the build-up wear-resistant copper-based alloy according to the present invention, as for the upper limit value of the aforementioned content range of manganese, it is possible to exemplify 29.0%, 28.0%, 27.0%, or 25.0%; and, as for the lower limit value, which corresponds to the upper limit value, it is possible to exemplify 3.3%, 3.5%, or 4%; however, they are not limited to these.

Element, which combines with manganese to form a Laves phase and additionally to form silicide: 3.0-30.0%

As for an element, which combines with manganese to form a Laves phase and additionally to form silicide, one member or two or more members of titanium, hafnium, zirconium, vanadium, niobium and tantalum are exemplified. These elements combine with manganese to form a Laves phase, and additionally combine with silicon to generate silicide (silicide having toughness generally) within the hard particles, and enhance the wear resistance and lubricating property at high temperatures. This silicide is such that the hardness is lower than Co—Mo system suicides; and that the toughness is high. Hence, it generates within the hard particles to enhance the wear resistance as well as the toughness.

When the content is less than the lower limit value, the wear resistance degrades, and the improving effects are not demonstrated sufficiently. Moreover, when it exceeds the upper limit value, the hard particles become excessive, the toughness is impaired, and the cracking resistance degrades so that cracks are likely to occur. Considering the aforementioned circumstances, it is 3.0-30.%. For example, it can be 3.1-19.0%, especially, 3.2-18.0%. Depending on the degree of attaching importance to various properties required for the build-up wear-resistant copper-based alloy according to the present invention, as for the lower limit value of the content range of the aforementioned element (one member or two or more members of titanium, hafnium, zirconium, vanadium, niobium and tantalum), it is possible to exemplify 3.2%, 3.5%, or 4.0%; and, as for the upper limit value, which corresponds to the lower limit value, it is possible to exemplify 28.0%, 27.0%, or 26.0%; however, they are not limited to these.

One Member or Two or More Members of Titanium Carbide, Molybdenum Carbide, Tungsten Carbide, Chromium Carbide, Vanadium Carbide, Tantalum Carbide, Niobium Carbide, Zirconium Carbide and Hafnium Carbide: 0.01-10.0%

These carbides can be expected to effect the nucleation action of hard particles, and it is inferred that they can contributed to intending the miniaturization of hard particles and to making the cracking resistance and the wear resistance compatible. These carbides can be simple carbide, which is formed of carbide of one element, or can be composite carbide, which is formed of carbides of plural elements. When the aforementioned carbides are less than the lower limit value of the aforementioned content, the improving effects are not necessarily sufficient. When they exceed the upper limit value of the aforementioned content, a tendency of hindering the cracking resistance is perceived. Considering the aforementioned circumstances, they are 0.01-10.0%. Preferably, it can be 0.02-9.0%, or 0.05-8%, further, 0.05-7.0%, alternatively, 0.5-2.0%, or 0.7-1.5%. Depending on the degree of attaching importance to various properties required for the build-up wear-resistant copper-based alloy according to the present invention, as for the upper limit value of the aforementioned content range of the aforementioned carbides, it is possible to exemplify 9.0%, 8.0%, 7.0%, or 6.0%; and, as for the lower limit value, which corresponds to the lower limit value, it is possible to exemplify 0.02%, 0.04%, or 0.1%; however, they are not limited to these. Note it can be provided with niobium carbide simultaneously along with the aforementioned carbides. Moreover, the aforementioned carbides are contained depending on needs, and even the cases where the aforementioned carbides are not contained can be allowed. Note that the carbide can be cognate with the alloying element. For example, when being the titanium containment, it is possible to employ titanium carbide; and, when being the hafnium containment, it is possible to employ hafnium carbide.

The build-up wear-resistant copper-based alloy according to the present invention can employ at least one of the following embodiment modes.

The build-up wear-resistant copper-based alloy according to the present invention is used as build-up alloys which are built up onto physical objects. As for a build-up method, methods for building it up by welding it, using a high-density energy thermal source, such as laser beams, electron beams and arcs. In the case of building up, the build-up wear resistant copper-based alloy according to the present invention is turned into a powder or a bulky body to make a raw material for building up, and can be built it up by welding it, using a thermal source which is represented by the aforementioned high-density energy thermal source, such as laser beams, electron beams and arcs, with the powder or bulky body being assembled onto a portion to be built up. Moreover, the aforementioned build-up wear-resistant copper-based alloy can be turned into a wired or rod-shaped raw workpice for building up, not being limited to the powder or bulky body. As for the laser beams, those which have high energy densities, such as carbon dioxide laser beams and YAG laser beams, are exemplified. As for the material qualities of the physical objects to be built up, aluminum, aluminum system alloys, iron or iron system alloys, copper or copper system alloys, and the like, are exemplified, however, they are not limited to these. As for the fundamental compositions of aluminum alloys constituting the physical objects, aluminum alloys for casting, such as Al—Si systems, Al—Cu systems, Al—Mg systems and Al—Zn systems, are exemplified, for instance, however, they are not limited to these. As for the physical objects, engines, such as internal combustion engines and external combustion engines, are exemplified, however, they are not limited to these. In the case of internal combustion engines, dynamic-valve-system materials are exemplified. In this instance, it can be applied to valve seats constituting exhaust ports, or can be applied to valve seats constituting intake ports. In this instance, the valve seats themselves can be constituted of the build-up wear-resistant copper-based alloy according to the present invention, or the build-up wear-resistant copper-based alloy according to the present invention can be built up onto the valve seats. However, the build-up wear-resistant copper-based alloy according to the present invention is not limited to the dynamic-valve-system materials for engines, such as internal combustion engines, but can be used as well for the other systems' sliding build-up materials, for which wear resistance is requested.

As for the build-up wear-resistant copper-based alloy according to the present invention, it can constitute built-up layers after building up, or it can be alloys for building up prior to building up.

EXAMPLES

Example No. 1

Hereinafter, Example No. 1 of the present invention will be described specifically along with reference examples. The compositions (analyzed compositions) of samples ("T" series, "T" means the containment of titanium) according to build-up wear-resistant copper-based alloys used in the present example are set forth in Table 1. The analyzed compositions basically conform to the blended compositions. As set forth in Table 1, the compositions of Example No. 1 do not contain cobalt, iron and molybdenum as active elements, but, contain titanium, and are set up within the compositions, which include nickel: 5.0-20.0%, silicon: 0.5-5.0%, and manganese: 3.0-30.0%, as well as titanium: 3.0-30.0%, by weight %, and the balance: copper. Note that, Sample "i," Sample "a," Sample "c," Sample "e," Sample "g," and Sample "x," which are set forth in Table 1, deviate from the compositional range of claim 1, and specify reference examples.

The aforementioned respective samples are powders which are produced by processing by means of gas atomizing alloy molten metals, which are melted in high vacuum. The particle sizes of the powders are 5 μm-300 μm. The processing by means of gas atomizing was carried out by spouting high-temperature molten metals through a nozzle in a non-oxidizing atmosphere (in argon-gas or nitrogen-gas atmosphere) Since the aforementioned powders are formed by processing by means of gas atomizing, the componential uniformities are high.

And, as illustrated in FIG. 1, using a substrate 50 formed of an aluminum alloy (material quality: AC2C) being a physical object for building up, a laser beam 55 of carbon dioxide laser was swung by a beam oscillator 57, and additionally the laser beam 55 and the substrate 50 were moved relatively, in such a state that the aforementioned samples (powdery) were placed on a subject-to-building-up portion 51 of the substrate 50 to form a sample layer 53; thus, the laser beam 55 was irradiated onto the sample layer 53, thereby melting and then solidifying the sample 53 to form a built-up layer 60 (built-up thickness: 2.0 mm, and built-up width: 6.0 mm) on the subject-to-building-up portion 51 of the substrate 50.

At this moment, it was carried out while spraying a shielding gas (argon gas) onto the building-up location through a gas supplying pipe 65. In the aforementioned irradiation treatment, the laser beam 55 was swung by the beam oscillator 57 in the widthwise direction (arrowheaded "W" directions) of the sample layer 53. In the aforementioned irradiation treatment, the laser output of the carbon dioxide gas laser was 4.5 kW, the spot diameter of the laser beam 55 at the sample layer 53 was 2.0 mm, the relative travelling speed between the laser beam 55 and the substrate 50 was 15.0 mm/sec, and the shielding-gas flow rate was 10 liter/min. Regarding the other samples as well, the built-up layers were formed similarly, respectively.

When examining the built-up layers formed of the respective samples, the hard particles, which had hard phases, were dispersed in the matrices of the built-up layers. The volumetric ratio of the hard particles, which occupied in the build-up wear-resistant copper-based alloys, fell within 5-60% approximately of 100% when the build-up wear-resistant copper-based alloys were taken as 100%. The average hardness of the matrices, the average hardness of the hard particles, and the size of the hard particles were within the above-described ranges.

Figure 2:
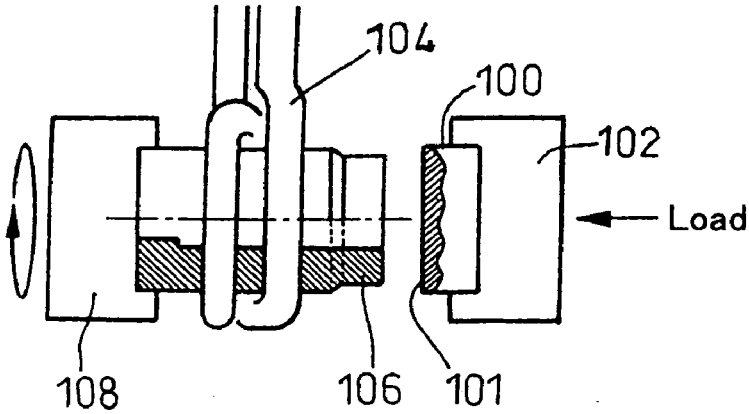
FIG. 2 is a constructional diagram for schematically illustrating a state in which a wear-resistant test is carried out with respect to a test specimen, which has a built-up layer.

Regarding the built-up layers formed using the respective samples, the cracking occurrence rate was examined. Further, a wear test was carried out to examine the wear amount with regard to the built-up layers formed using the respective samples. The wear test is such that, as illustrated in FIG. 2, a test was carried out by rotating a mating member 106 and pressing an axial end surface of the mating member 106 onto a built-up layer 101 of a test specimen, 100 while heating the mating member 106 by high-frequency induction with an induction coil 104, in such a state that the test specimen 100 provided with the built-up layer 101 was held in a first holder 102 and additionally the cylinder-shaped mating member 106, in which the induction coil 104 was would around the outer periphery, was held in a second holder 108. As for the testing conditions, the load was 2.0 MPa, the sliding speed was 0.3 m/sec, the testing time was 1.2 ksec, and the surface temperature of the test specimen 100 was 323-523 K. As for the mating member 106, one, in which the surface of a material equivalent to JIS-SUH35 was covered with a wear-resistant copper-based alloy Stellite, was used. Further, a cutting test was carried out to examine the machinability of the built-up layers formed using the respective samples as well. The cutting test is such that the number of processed units, that is, the number of cylinder heads with built-up layers formed, was evaluated, number which could be subjected to cutting with one machining cutting tool.

Table 1, in addition to the compositions of the respective samples, sets forth the test results of the cracking occurrence rate (%) during building up at the built-up layers, the wear weight (mg) of the built-up layers in the wear test, and the machinability (the number of units) of the built-up layers in the cutting test,. Here, the less cracking occurrence rate implies that the more satisfactory the cracking resistance is. The less wear weight implies that the more satisfactory the wear resistance is. The more number of units implies that the more satisfactory the machinability is.

In accordance with Sample "i," Sample "a," Sample "c," Sample "e," Sample "g" and Sample "x" which are reference examples, since the cobalt amount is decreased to 2% or less, the Co—Mo system silicides, which have the hard and brittle property, are decreased or vanished, and additionally the proportion of silicides, which have such properties that the hardness is lower and the toughness is slightly higher than the Co—Mo system silicides, can be increased, and accordingly it is possible to enhance the wear resistance, cracking resistance and machinability in high-temperature regions in a well balanced manner.

However, since they have become all the more strict required characteristics recently, it has been required to enhance the wear resistance, cracking resistance and machinability in a much better balanced manner. Here, as set forth in Table 1, regarding Sample "i" according to the reference examples, although the wear weight is satisfactory, the machinability and cracking resistance are not sufficient. Regarding Sample "a" according to the reference examples, although the wear weight is satisfactory, the cracking resistance and machinability are not sufficient. Regarding Sample "c" and Sample "g" according to the reference examples, although the cracking resistance is satisfactory, the wear weight is large and the machinability is not sufficient as well.

On the contrary, regarding the built-up layers formed of the respective samples according to Example No. 1, the cracking occurrence rate was so low as 0%, and accordingly the cracking resistance was satisfactory. Even when the titanium content was changed, the cracking occurrence rate was 0%, and accordingly the cracking resistance was satisfactory.

Further, when having a look at the wear weight, regarding the built-up layers formed of Sample "c" and Sample "g" according to the reference examples, although a wear-resistance improvement effect was appreciated, the wear weight was great still to exceed 10 mg, and it was not necessarily sufficient, however, on the contrary, regarding the built-up layers formed of the samples according to Example No. 1, the wear weight was 9 mg or less and was low, the wear-resistance improvement effect was satisfactory. Especially, regarding the built-up layers formed of Sample "T2" and Sample "T7," the wear weight was low.

On the machinability, regarding the built-up layer formed of Sample "a" according to the reference examples, the number of processed units was so less that it was not satisfactory, however, regarding the built-up layer formed of the samples according to Example No. 1, satisfactory machinability was obtained. Therefore, as it is possible to understand from the test results set forth in Table 1, it was found out that the built-up layers formed of the build-up wear-resistant copper-based alloys of the respective samples according to Example No. 1 are such that the cracking resistance, wear resistance and machinability are obtained in a well balanced manner. Especially, it was found out that the cracking resistance is satisfactory.

Example No. 2

Hereinafter, Example No. 2 of the present invention will be described specifically. In the present example as well, built-up layers were formed under similar conditions to Example No. 1 basically. The compositions of samples ("H" series, "H" means the containment of hafnium) according to build-up wear-resistant copper-based alloys used in the present example are set forth in Table 2. As set forth in Table 2, the compositions of Example No. 2 do not contain cobalt, iron and molybdenum actively, but, contain hafnium, and are set up within the compositions, which include nickel: 5.0-20.0%, silicon: 0.5-5.0%, manganese: 3.0-30.0%, hafnium: 3.0-30.0%, by weight %, and the balance: copper.

When examining the built-up layers formed of the respective samples, the hard particles, which had hard phases, were dispersed in the matrices of the built-up layers. The volumetric ratio of the hard particles, which occupied in the build-up wear-resistant copper-based alloys, fell within 5-60% approximately of 100% when the build-up wear-resistant copper-based alloys were taken as 100%. The average hardness of the matrices, the average hardness of the hard particles, and the size of the hard particles were within the above-described ranges.

As set forth in Table 2, when having a look at the cracking occurrence rate, regarding the built-up layers formed of the samples according to Example No. 2, the cracking occurrence rate was low, and was 0%. Even when the hafnium content was changed, the cracking occurrence rate was 0%.

When having a look at the wear weight, regarding the built-up layers formed of the samples according to Example No. 2, the wear weight was 8 mg or less, and was low. Especially, regarding the built-up layer formed of Sample "H2," "H6" and "H7," the wear weight was low. On the machinability as well, the number of processed units was many, and accordingly it was sufficient. Therefore, as it is possible to understand from the test results set forth in Table 2, it was found out that the built-up layers formed of the build-up wear-resistant copper-based alloys of the samples according to Example No. 2 are such that the cracking resistance, wear resistance and machinability are obtained in a well balanced manner. Especially, it was found out that the cracking resistance is satisfactory.

Example No. 3

Hereinafter, Example No. 3 of the present invention will be described specifically. In the present example as well, built-up layers were formed under similar conditions to Example No. 1 basically. The compositions of samples ("Z" series, "Z" means the containment of zirconium) according to build-up wear-resistant copper-based alloys used in the present example are set forth in Table 3. As set forth in Table 3, the compositions of Example No. 3 do not contain cobalt, iron and molybdenum actively, but, contain zirconium, and are set up within the compositions, which include nickel: 5.0-20.0%, silicon: 0.5-5.0%, manganese: 3.0-30.0%, zirconium: 3.0-30.0%, by weight %, and the balance: copper.

As set forth in Table 3, when having a look at the cracking occurrence rate, regarding the built-up layers formed of the samples according to Example No. 3, the cracking occurrence rate was low, and was 0%. Even when the zirconium content was changed, the cracking occurrence rate was 0%. When having a look at the wear weight, regarding the built-up layers formed of the samples according to Example No. 3, the wear weight was 10 mg or less, and was low. Especially, regarding the built-up layers formed of Sample "Z2" and Sample "Z7," the wear weight was low. On the machinability as well, the number of processed units was many, and accordingly it was sufficient. Therefore, as it is possible to understand from the test results set forth in Table 3, it was found out that the built-up layers formed of the build-up wear-resistant copper-based alloys of the samples according to Example No. 3 are such that the cracking resistance, wear resistance and machinability are obtained in a well balanced manner. Especially, it was found out that the cracking resistance is satisfactory.

Example No. 4

Hereinafter, Example No. 4 of the present invention will be described specifically. In the present example as well, built-up layers were formed under similar conditions to Example No. 1 basically. The compositions of samples ("V" series, "V" means the containment of vanadium) according to build-up wear-resistant copper-based alloys used in the present example are set forth in Table 4. As set forth in Table 4, the compositions of Example No. 4 do not contain cobalt, iron and molybdenum actively, and are set up within the compositions, which include nickel: 5.0-20.0%, silicon: 0.5-5.0%, manganese: 3.0-30.0%, vanadium: 3.0-30.0%, by weight %, and the balance: copper.

As set forth in Table 4, when having a look at the cracking occurrence rate, regarding the built-up layers formed of the samples according to Example No. 4, the cracking occurrence rate was low, and was 0%. Even when the zirconium content was changed, the cracking occurrence rate was 0%. When having a look at the wear weight, regarding the built-up layers formed of the samples according to Example No. 4, the wear weight was 9 mg or less, and was low. Especially, regarding the built-up layers formed of Samples "V2" and "V7," the wear weight was low. On the machinability as well, the number of processed units was many, and accordingly it was sufficient. Therefore, as it is possible to understand from the test results set forth in Table 4, it was found out that the built-up layers formed of the build-up wear-resistant copper-based alloys of the samples according to Example No. 4 are such that the cracking resistance, wear resistance and machinability are obtained in a well balanced manner. Especially, it was found out that the cracking resistance is satisfactory.

Example No. 5

Hereinafter, Example No. 4 of the present invention will be described specifically. In the present example as well, built-up layers were formed under similar conditions to Example No. 1 basically. The compositions of samples ("N" series, "N" means the containment of niobium) according to build-up wear-resistant copper-based alloys used in the present example are set forth in Table 5. As set forth in Table 5, the compositions of Example No. 5 do not contain cobalt, iron and molybdenum actively, and are set up within the compositions, which include nickel: 5.0-20.0%, silicon: 0.5-5.0%, manganese: 3.0-30.0%, niobium: 3.0-30.0%, by weight%, and the balance: copper.

As set forth in Table 5, when having a look at the cracking occurrence rate, regarding the built-up layers formed of the samples according to Example No. 5, the cracking occurrence rate was low, and was 0%. Even when the niobium content was changed, the cracking occurrence rate was 0%. When having a look at the wear weight, regarding the built-up layers formed of the samples according to Example No. 5, the wear weight was 8 mg or less, and was low. Especially, regarding the built-up layers formed of Sample "N2," "N6" and "N7," the wear weight was low. On the machinability as well, the number of processed units was many, and accordingly it was sufficient. Therefore, as it is possible to understand from the test results set forth in Table 5, it was found out that the built-up layers formed of the build-up wear-resistant copper-based alloys of the samples according to Example No. 5 are such that the cracking resistance, wear resistance and machinability are obtained in a well balanced manner. Especially, it was found out that the cracking resistance is satisfactory.

Example No. 6

Hereinafter, Example No. 6 of the present invention will be described specifically. In the present example as well, built-up layers were formed under similar conditions to Example No. 1 basically. The compositions of samples ("A" series, "A" means the containment of tantalum) according to build-up wear-resistant copper-based alloys used in the present example are set forth in Table 6. As set forth in Table 6, the compositions of Example No. 6 do not contain cobalt, iron and molybdenum actively, and are set up within the compositions, which include nickel: 5.0-20.0%, silicon: 0.5-5.0%, manganese: 3.0-30.0%, tantalum: 3.0-30.0%, by weight %, and the balance: copper.

As set forth in Table 6, when having a look at the cracking occurrence rate, regarding the built-up layers formed of the samples according to Example No. 6, the cracking occurrence rate was low, and was 0%. Even when the tantalum content was changed, the cracking occurrence rate was 0%. When having a look at the wear weight, regarding the built-up layers formed of the samples according to Example No. 5, the wear weight was 11 mg or less, and was low. Especially, regarding the built-up layers formed of Sample "A2" and "A7," the wear weight was low. On the machinability as well, the number of processed units was many, and accordingly it was sufficient. Therefore, as it is possible to understand from the test results set forth in Table 6, it was found out that the built-up layers formed of the build-up wear-resistant copper-based alloys of the samples according to Example No. 6 are such that the cracking resistance, wear resistance and machinability are obtained in a well balanced manner. Especially, it was found out that the cracking resistance is satisfactory.

Example No. 7

Hereinafter, Example No. 7 of the present invention will be described specifically. In the present example as well, built-up layers were formed under similar conditions to Example No. 1 basically. The compositions of samples ("TC" series, "TC" means the containment of titanium and titanium carbide) according to build-up wear-resistant copper-based alloys used in the present example are set forth in Table 7. As set forth in Table 7, the compositions of Example No. 7 do not contain cobalt, iron and molybdenum actively, and are set up within the compositions, which include nickel: 5.0-20.0%, silicon: 0.5-5.0%, manganese: 3.0-30.0%, titanium: 3.0-30.0%, titanium carbide (TiC): 1.2%, by weight%, and the balance: copper. As set forth in Table 7, when having a look at the cracking occurrence rate, regarding the built-up layers formed of the samples according to Example No. 7, the cracking occurrence rate was low, and was 0%. Even when the titanium and titanium carbide contents were changed, the cracking occurrence rate was 0%. When having a look at the wear weight, regarding the built-up layers formed of the samples according to Example No. 7, the wear weight was 9 mg or less, and was low. Especially, regarding the built-up layers formed of Sample "TC2" and "TC7," the wear weight was low. On the machinability as well, the number of processed units was many, and accordingly it was sufficient. Therefore, as it is possible to understand from the test results set forth in Table 7, it was found out that the built-up layers formed of the build-up wear-resistant copper-based alloys of the samples according to Example No. 7 are such that the cracking resistance, wear resistance and machinability are obtained in a well balanced manner. Especially, it was found out that the cracking resistance is satisfactory.

Example No. 8

Hereinafter, Example No. 8 of the present invention will be described specifically. In the present example as well, built-up layers were formed under similar conditions to Example No. 1 basically. The compositions of samples ("AC" series, "AC" means the containment of tantalum and tantalum carbide) according to build-up wear-resistant copper-based alloys used in the present example are set forth in Table 8. As set forth in Table 8, the compositions of Example No. 8 do not contain cobalt, iron and molybdenum actively, and are set up within the compositions, which include nickel: 5.0-20.0%, silicon: 0.5-5.0%, manganese: 3.0-30.0%, tantalum: 3.0-30.0%, tantalum carbide (TaC): 1.2%, by weight %, and the balance: copper.

As set forth in Table 8, when having a look at the cracking occurrence rate, regarding the built-up layers formed of the samples according to Example No. 8, the cracking occurrence rate was low, and was 0%. Even when the tantalum and tantalum carbide contents were changed, the cracking occurrence rate was 0%. When having a look at the wear weight, regarding the built-up layers formed of the samples according to Example No. 8, the wear weight was 9 mg or less, and was low. Especially, regarding the built-up layers formed of Sample "AC2" and Sample "AC7," the wear weight was lower. On the machinability as well, the number of processed units was many, and accordingly it was sufficient. Therefore, as it is possible to understand from the test results set forth in Table 8, it was found out that the built-up layers formed of the build-up wear-resistant copper-based alloys of the samples according to Example No. 8 are such that the cracking resistance, wear resistance and machinability are obtained in a well balanced manner. Especially, it was found out that the cracking resistance is satisfactory.

Example No. 9

Hereinafter, Example No. 9 of the present invention will be described specifically. In the present example as well, built-up layers were formed under similar conditions to Example No. 1 basically. The compositions of samples ("ZC" series, "ZC" means the containment of zirconium and zirconium carbide) according to build-up wear-resistant copper-based alloys used in the present example are set forth in Table 9. As set forth in Table 9, the compositions of Example No. 9 do not contain cobalt, iron and molybdenum actively, and are set up within the compositions, which include nickel: 5.0-20.0%, silicon: 0.5-5.0%, manganese: 3.0-30.0%, zirconium: 3.0-30.0%, zirconium carbide (ZrC): 1.2%, by weight %, and the balance: copper.

As set forth in Table 9, when having a look at the cracking occurrence rate, regarding the built-up layers formed of the samples according to Example No. 9, the cracking occurrence rate was low, and was 0%. Even when the titanium and titanium carbide contents were changed, the cracking occurrence rate was 0%. When having a look at the wear weight, regarding the built-up layers formed of the samples according to Example No. 9, the wear weight was 8 mg or less, and was low. Especially, regarding the built-up layers formed of Sample "ZC2" and Sample "ZC7," the wear weight was low. On the machinability as well, the number of processed units was many, and accordingly it was sufficient. Therefore, as it is possible to understand from the test results set forth in Table 9, it was found out that the built-up layers formed of the build-up wear-resistant copper-based alloys of the samples according to Example No. 9 are such that the cracking resistance, wear resistance and machinability are obtained in a well balanced manner. Especially, it was found out that the cracking resistance is satisfactory.

Example No. 10

Hereinafter, Example No. 10 of the present invention will be described specifically. In the present example as well, built-up layers were formed under similar conditions to Example No. 1 basically. The compositions of samples ("NC" series, "NC" means the containment of niobium and niobium carbide) according to build-up wear-resistant copper-based alloys used in the present example are set forth in Table 10. As set forth in Table 10, the compositions of Example No. 10 do not contain cobalt, iron and molybdenum actively, and are set up within the compositions, which include nickel: 5.0-20.0%, silicon: 0.5-5.0%, manganese: 3.0-30.0%, niobium: 3.0-30.0%, niobium carbide (NbC): 1.2%, by weight %, and the balance: copper.

As set forth in Table 10, when having a look at the cracking occurrence rate, regarding the built-up layers formed of the samples according to Example No. 10, the cracking occurrence rate was low, and was 0%. Even when the niobium and niobium carbide contents were changed, the cracking occurrence rate was 0%. When having a look at the wear weight, regarding the built-up layers formed of the samples according to Example No. 10, the wear weight was 7 mg or less, and was low. Especially, regarding the built-up layers formed of Sample "NC2" and Sample "NC7," the wear weight was low. On the machinability as well, the number of processed units was many, and accordingly it was sufficient. Therefore, as it is possible to understand from the test results set forth in Table 10, it was found out that the built-up layers formed of the build-up wear-resistant copper-based alloys of the samples according to Example No. 10 are such that the cracking resistance, wear resistance and machinability are obtained in a well balanced manner. Especially, it was found out that the cracking resistance is satisfactory.

Example No. 11

Hereinafter, Example No. 11 of the present invention will be described specifically. In the present example as well, built-up layers were formed under similar conditions to Example No. 1 basically. The compositions of samples ("HC" series, "HC" means the containment of hafnium and hafnium carbide) according to build-up wear-resistant copper-based alloys used in the present example are set forth in Table 11. As set forth in Table 11, the compositions of Example No. 11 do not contain cobalt, iron and molybdenum actively, and are set up within the compositions, which include nickel: 5.0-20.0%, silicon: 0.5-5.0%, manganese: 3.0-30.0%, hafnium: 3.0-30.0%, hafnium carbide (HfC): 1.2%, by weight %, and the balance: copper.

As set forth in Table 11, when having a look at the cracking occurrence rate, regarding the built-up layers formed of the samples according to Example No. 11, the cracking occurrence rate was low, and was 0%. Even when the hafnium and hafnium carbide contents were changed, the cracking occurrence rate was 0%. When having a look at the wear weight, regarding the built-up layers formed of the samples according to Example No. 11, the wear weight was 7 mg or less, and was low. Especially, regarding the built-up layers formed of Sample "HC2" and Sample "HC7," the wear weight was low. On the machinability as well, the number of processed units was many, and accordingly it was sufficient. Therefore, as it is possible to understand from the test results set forth in Table 11, it was found out that the built-up layers formed of the build-up wear-resistant copper-based alloys of the samples according to Example No. 11 are such that the cracking resistance, wear resistance and machinability are obtained in a well balanced manner. Especially, it was found out that the cracking resistance is satisfactory.

TABLE 1

| | | Composition of Titanium-containing Build-up Wear-resistant Copper-based Alloy Weight % | | | | | | | | Cracking Occurrence | Wear Weight Valve Seat | Machinability |
|---|---|---|---|---|---|---|---|---|---|---|---|---|
| | Sample | Cu | Ni | Si | Ti | Mn | Fe | Co | | Rate % | mg | Units |
| Example No. 1 | T1 | Balance | 17.5 | 2.3 | 17.5 | 17.5 | — | — | | 0 | 4-5 | 740 |
| | T2 | Balance | 20.0 | 2.3 | 30.0 | 30.0 | — | — | | 0 | 1-2 | 460 |
| | T3 | Balance | 5.5 | 2.3 | 5.5 | 4.5 | — | — | | 0 | 7-8 | 840 |
| | T4 | Balance | 5.0 | 2.3 | 3.0 | 3.0 | — | — | | 0 | 7-8 | 760 |
| | T5 | Balance | 18.0 | 2.3 | 8.0 | 10.0 | — | — | | 0 | 5-6 | 720 |
| | T6 | Balance | 17.5 | 2.3 | 17.5 | 17.5 | — | — | | 0 | 2-3 | 680 |
| | T7 | Balance | 20.0 | 2.3 | 30.0 | 30.0 | — | — | | 0 | 1-2 | 440 |
| | T8 | Balance | 5.5 | 2.3 | 5.5 | 4.5 | — | — | | 0 | 4-6 | 780 |
| | T9 | Balance | 5.0 | 2.3 | 3.0 | 3.0 | — | — | | 0 | 5-7 | 740 |
| | T10 | Balance | 18.0 | 2.3 | 8.0 | 8.0 | — | — | | 0 | 5-6 | 700 |
| Reference Example | i | Balance | 18.0 | 2.3 | Mo 8.0 | 10.5 | 1.5 | 1.0 | | 1.0 | 4-5 | 330 |
| | a | Balance | 22.5 | 2.3 | Mo 22.5 | 12.5 | 1.5 | 1.0 | | 1.5 | 2-3 | 180 |
| | c | Balance | 12.5 | 2.3 | Mo 12.5 | 22.5 | 1.5 | 1.0 | | 0.20 | 10-12 | 280 |
| | g | Balance | 2.5 | 2.3 | Mo 2.5 | 7.5 | 1.5 | 1.0 | | 0 | 12-16 | 370 |
| | x | Balance | 18.0 | 2.3 | Mo 8.0 | 10.0 | 1.5 | 1.0 | NbC 1.2 | 0 | 3-4 | 350 |

TABLE 2

| | | Composition of Hafnium-containing Build-up Wear-resistant Copper-based Alloy Weight % | | | | | | | Cracking Occurrence | Wear Weight Valve Seat | Machinability |
|---|---|---|---|---|---|---|---|---|---|---|---|
| | Sample | Cu | Ni | Si | Hf | Mn | Fe | Co | Rate % | mg | Units |
| Example No. 2 | H1 | Balance | 17.5 | 2.3 | 17.5 | 17.5 | — | — | 0 | 3-4 | 720 |
| | H2 | Balance | 20.0 | 2.3 | 30.0 | 30.0 | — | — | 0 | 1-2 | 440 |
| | H3 | Balance | 5.5 | 2.3 | 5.5 | 4.5 | — | — | 0 | 6-7 | 820 |
| | H4 | Balance | 5.0 | 2.3 | 3.0 | 3.0 | — | — | 0 | 6-7 | 740 |
| | H5 | Balance | 18.0 | 2.3 | 8.0 | 10.0 | — | — | 0 | 4-5 | 700 |
| | H6 | Balance | 17.5 | 2.3 | 17.5 | 17.5 | — | — | 0 | 1-2 | 640 |
| | T7 | Balance | 20.0 | 2.3 | 30.0 | 30.0 | — | — | 0 | 1-2 | 440 |
| | H8 | Balance | 5.5 | 2.3 | 5.5 | 4.5 | — | — | 0 | 3-5 | 760 |
| | H9 | Balance | 5.0 | 2.3 | 3.0 | 3.0 | — | — | 0 | 4-6 | 720 |
| | H10 | Balance | 18.0 | 2.3 | 8.0 | 8.0 | — | — | 0 | 4-6 | 680 |

TABLE 3

| | | Composition of Zirconium-containing Build-up Wear-resistant Copper-based Alloy Weight % | | | | | | | Cracking Occurrence | Wear Weight Valve Seat | Machinability |
|---|---|---|---|---|---|---|---|---|---|---|---|
| | Sample | Cu | Ni | Si | Zr | Mn | Fe | Co | Rate % | mg | Units |
| Example No. 3 | Z1 | Balance | 17.5 | 2.3 | 17.5 | 17.5 | — | — | 0 | 4-6 | 760 |
| | Z2 | Balance | 20.0 | 2.3 | 30.0 | 30.0 | — | — | 0 | 1-2 | 480 |
| | Z3 | Balance | 5.5 | 2.3 | 5.5 | 4.5 | — | — | 0 | 8-9 | 860 |
| | Z4 | Balance | 5.0 | 2.3 | 3.0 | 3.0 | — | — | 0 | 8-9 | 780 |
| | Z5 | Balance | 18.0 | 2.3 | 8.0 | 10.0 | — | — | 0 | 4-6 | 740 |
| | Z6 | Balance | 17.5 | 2.3 | 17.5 | 17.5 | — | — | 0 | 3-4 | 700 |
| | Z7 | Balance | 20.0 | 2.3 | 30.0 | 30.0 | — | — | 0 | 1-2 | 460 |
| | Z8 | Balance | 5.5 | 2.3 | 5.5 | 4.5 | — | — | 0 | 5-6 | 820 |
| | Z9 | Balance | 5.0 | 2.3 | 3.0 | 3.0 | — | — | 0 | 6-8 | 760 |
| | Z10 | Balance | 18.0 | 2.3 | 8.0 | 8.0 | — | — | 0 | 4-6 | 720 |

TABLE 4

| | | Composition of Vanadium-containing Build-up Wear-resistant Copper-based Alloy Weight % | | | | | | | Cracking Occurrence | Wear Weight Valve Seat | Machinability |
|---|---|---|---|---|---|---|---|---|---|---|---|
| | Sample | Cu | Ni | Si | V | Mn | Fe | Co | Rate % | mg | Units |
| Example No. 4 | V1 | Balance | 17.5 | 2.3 | 17.5 | 17.5 | — | — | 0 | 4-5 | 760 |
| | V2 | Balance | 20.0 | 2.3 | 30.0 | 30.0 | — | — | 0 | 1-2 | 480 |
| | V3 | Balance | 5.5 | 2.3 | 5.5 | 4.5 | — | — | 0 | 7-8 | 860 |
| | V4 | Balance | 5.0 | 2.3 | 3.0 | 3.0 | — | — | 0 | 7-8 | 780 |
| | V5 | Balance | 18.0 | 2.3 | 8.0 | 10.0 | — | — | 0 | 5-6 | 740 |
| | V6 | Balance | 17.5 | 2.3 | 17.5 | 17.5 | — | — | 0 | 2-3 | 700 |
| | V7 | Balance | 20.0 | 2.3 | 30.0 | 30.0 | — | — | 0 | 1-2 | 460 |
| | V8 | Balance | 5.5 | 2.3 | 5.5 | 4.5 | — | — | 0 | 4-6 | 800 |
| | V9 | Balance | 5.0 | 2.3 | 3.0 | 3.0 | — | — | 0 | 5-7 | 760 |
| | V10 | Balance | 18.0 | 2.3 | 8.0 | 8.0 | — | — | 0 | 5-6 | 720 |

TABLE 5

| | | Composition of Niobium-containing Build-up Wear-resistant Copper-based Alloy Weight % | | | | | | | Cracking Occurrence | Wear Weight Valve Seat | Machinability |
|---|---|---|---|---|---|---|---|---|---|---|---|
| | Sample | Cu | Ni | Si | Nb | Mn | Fe | Co | Rate % | mg | Units |
| Example No. 5 | N1 | Balance | 17.5 | 2.3 | 17.5 | 17.5 | — | — | 0 | 3-4 | 740 |
| | N2 | Balance | 20.0 | 2.3 | 30.0 | 30.0 | — | — | 0 | 1-2 | 460 |
| | N3 | Balance | 5.5 | 2.3 | 5.5 | 4.5 | — | — | 0 | 6-7 | 840 |
| | N4 | Balance | 5.0 | 2.3 | 3.0 | 3.0 | — | — | 0 | 6-7 | 760 |
| | N5 | Balance | 18.0 | 2.3 | 8.0 | 10.0 | — | — | 0 | 4-5 | 720 |
| | N6 | Balance | 17.5 | 2.3 | 17.5 | 17.5 | — | — | 0 | 1-2 | 660 |
| | N7 | Balance | 20.0 | 2.3 | 30.0 | 30.0 | — | — | 0 | 1-2 | 460 |
| | N8 | Balance | 5.5 | 2.3 | 5.5 | 4.5 | — | — | 0 | 3-5 | 780 |
| | N9 | Balance | 5.0 | 2.3 | 3.0 | 3.0 | — | — | 0 | 4-6 | 740 |
| | N10 | Balance | 18.0 | 2.3 | 8.0 | 8.0 | — | — | 0 | 4-6 | 700 |

TABLE 6

| | | Composition of Tantalum-containing Build-up Wear-resistant Copper-based Alloy Weight % | | | | | | | Cracking Occurrence | Wear Weight Valve Seat | Machinability |
|---|---|---|---|---|---|---|---|---|---|---|---|
| | Sample | Cu | Ni | Si | Ta | Mn | Fe | Co | Rate % | mg | Units |
| Example No. 6 | A1 | Balance | 17.5 | 2.3 | 17.5 | 17.5 | — | — | 0 | 5-7 | 780 |
| | A2 | Balance | 20.0 | 2.3 | 30.0 | 30.0 | — | — | 0 | 2-3 | 500 |
| | A3 | Balance | 5.5 | 2.3 | 5.5 | 4.5 | — | — | 0 | 9-10 | 900 |
| | A4 | Balance | 5.0 | 2.3 | 3.0 | 3.0 | — | — | 0 | 9-10 | 800 |
| | A5 | Balance | 18.0 | 2.3 | 8.0 | 10.0 | — | — | 0 | 5-7 | 800 |

TABLE 6-continued

| | Composition of Tantalum-containing Build-up Wear-resistant Copper-based Alloy Weight % | | | | | | | | Cracking Occurrence | Wear Weight Valve Seat | Machinability |
|---|---|---|---|---|---|---|---|---|---|---|---|
| | Sample | Cu | Ni | Si | Ta | Mn | Fe | Co | Rate % | mg | Units |
| | A6 | Balance | 17.5 | 2.3 | 17.5 | 17.5 | — | — | 0 | 3-5 | 730 |
| | A7 | Balance | 20.0 | 2.3 | 30.0 | 30.0 | — | — | 0 | 2-3 | 480 |
| | A8 | Balance | 5.5 | 2.3 | 5.5 | 4.5 | — | — | 0 | 6-8 | 850 |
| | A9 | Balance | 5.0 | 2.3 | 3.0 | 3.0 | — | — | 0 | 7-9 | 800 |
| | A10 | Balance | 18.0 | 2.3 | 8.0 | 8.0 | — | — | 0 | 5-7 | 750 |

TABLE 7

| | Composition of Titanium-and-Titanium Carbide Containing Build-up Wear-resistant Copper-based Alloy Weight % | | | | | | | | | Cracking Occurrence | Wear Weight Valve Seat | Machinability |
|---|---|---|---|---|---|---|---|---|---|---|---|---|
| | Sample | Cu | Ni | Si | Mn | Tin | Fe | Co | Tic | Rate % | mg | Units |
| Example No. 7 | TC1 | Balance | 17.5 | 2.3 | 17.5 | 17.5 | — | — | 1.2 | 0 | 2-3 | 700 |
| | TC2 | Balance | 20.0 | 2.3 | 30.0 | 30.0 | — | — | 1.2 | 0 | 0.5-1 | 450 |
| | TC3 | Balance | 5.5 | 2.3 | 5.5 | 4.5 | — | — | 1.2 | 0 | 6-8 | 800 |
| | TC4 | Balance | 5.0 | 2.3 | 3.0 | 3.0 | — | — | 1.2 | 0 | 6-8 | 750 |
| | TC5 | Balance | 18.0 | 2.3 | 8.0 | 10.0 | — | — | 1.2 | 0 | 3-4 | 700 |
| | TC6 | Balance | 17.5 | 2.3 | 17.5 | 17.5 | — | — | 1.2 | 0 | 1-2 | 650 |
| | TC7 | Balance | 20.0 | 2.3 | 30.0 | 30.0 | — | — | 1.2 | 0 | 0.1-0.5 | 400 |
| | TC8 | Balance | 5.5 | 2.3 | 5.5 | 4.5 | — | — | 1.2 | 0 | 4-6 | 750 |
| | TC9 | Balance | 5.0 | 2.3 | 3.0 | 3.0 | — | — | 1.2 | 0 | 4-6 | 700 |
| | TC10 | Balance | 18.0 | 2.3 | 8.0 | 8.0 | — | — | 1.2 | 0 | 2-3 | 650 |

TABLE 8

| | Composition of Tantalum-and-Tantalum Carbide Containing Build-up Wear-resistant Copper-based Alloy Weight % | | | | | | | | | Cracking Occurrence | Wear Weight Valve Seat | Machinability |
|---|---|---|---|---|---|---|---|---|---|---|---|---|
| | Sample | Cu | Ni | Si | Mn | Ta | Fe | Co | Tac | Rate % | mg | Units |
| Example No. 8 | AC1 | Balance | 17.5 | 2.3 | 17.5 | 17.5 | — | — | 1.2 | 0 | 3-4 | 720 |
| | AC2 | Balance | 20.0 | 2.3 | 30.0 | 30.7 | — | — | 1.2 | 0 | 1-1.5 | 460 |
| | AC3 | Balance | 5.5 | 2.3 | 5.5 | 5.5 | — | — | 1.2 | 0 | 7-8 | 820 |
| | AC4 | Balance | 5.0 | 2.3 | 3.0 | 3.0 | — | — | 1.2 | 0 | 7-8 | 760 |
| | AC5 | Balance | 18.0 | 2.3 | 8.0 | 8.0 | — | — | 1.2 | 0 | 4-5 | 720 |
| | AC6 | Balance | 17.5 | 2.3 | 17.5 | 17.5 | — | — | 1.2 | 0 | 2-3 | 680 |
| | AC7 | Balance | 20.0 | 2.3 | 30.0 | 30.0 | — | — | 1.2 | 0 | 0.5-1.0 | 420 |
| | AC8 | Balance | 5.5 | 2.3 | 5.5 | 5.5 | — | — | 1.2 | 0 | 5-6 | 780 |
| | AC9 | Balance | 5.0 | 2.3 | 3.0 | 3.0 | — | — | 1.2 | 0 | 5-7 | 720 |
| | AC10 | Balance | 18.0 | 2.3 | 8.0 | 8.0 | — | — | 1.2 | 0 | 3-4 | 680 |

TABLE 9

| | Composition of Zirconium-and-Zirconium Carbide Containing Build-up Wear-resistant Copper-based Alloy Weight % | | | | | | | | | Cracking Occurrence | Wear Weight Valve Seat | Machinability |
|---|---|---|---|---|---|---|---|---|---|---|---|---|
| | Sample | Cu | Ni | Si | Mn | Zr | Fe | Co | ZrC | Rate % | mg | Units |
| Example No. 9 | ZC1 | Balance | 17.5 | 2.3 | 17.5 | 17.5 | — | — | 1.2 | 0 | 1-2 | 680 |
| | ZC2 | Balance | 20.0 | 2.3 | 30.0 | 30.0 | — | — | 1.2 | 0 | 0.5-0.7 | 420 |
| | ZC3 | Balance | 5.5 | 2.3 | 5.5 | 4.5 | — | — | 1.2 | 0 | 5-7 | 780 |
| | ZC4 | Balance | 5.0 | 2.3 | 3.0 | 3.0 | — | — | 1.2 | 0 | 5-7 | 720 |
| | ZC5 | Balance | 18.0 | 2.3 | 8.0 | 10.0 | — | — | 1.2 | 0 | 2-3 | 680 |
| | ZC6 | Balance | 17.5 | 2.3 | 17.5 | 17.5 | — | — | 1.2 | 0 | 1-1.5 | 640 |
| | ZC7 | Balance | 20.0 | 2.3 | 30.0 | 30.0 | — | — | 1.2 | 0 | 0.1-0.3 | 380 |
| | ZC8 | Balance | 5.5 | 2.3 | 5.5 | 4.5 | — | — | 1.2 | 0 | 3-4 | 740 |
| | ZC9 | Balance | 5.0 | 2.3 | 3.0 | 3.0 | — | — | 1.2 | 0 | 3-5 | 680 |
| | ZC10 | Balance | 18.0 | 2.3 | 8.0 | 8.0 | — | — | 1.2 | 0 | 1-2 | 640 |

TABLE 10

| | | Composition of Niobium-and-Niobium Carbide Containing Build-up Wear-resistant Copper-based Alloy Weight % | | | | | | | | Cracking Occurrence | Wear Weight Valve Seat | Machinability |
|---|---|---|---|---|---|---|---|---|---|---|---|---|
| | Sample | Cu | Ni | Si | Nb | Mn | Fe | Co | NbC | Rate % | mg | Units |
| Example No. 10 | NC1 | Balance | 17.5 | 2.3 | 17.5 | 17.5 | — | — | 1.2 | 0 | 1-1.5 | 660 |
| | NC2 | Balance | 20.0 | 2.3 | 30.0 | 30.0 | — | — | 1.2 | 0 | 0.5-0.6 | 400 |
| | NC3 | Balance | 5.5 | 2.3 | 5.5 | 4.5 | — | — | 1.2 | 0 | 4-6 | 760 |
| | NC4 | Balance | 5.0 | 2.3 | 3.0 | 3.0 | — | — | 1.2 | 0 | 4-6 | 700 |
| | NC5 | Balance | 18.0 | 2.3 | 8.0 | 10.0 | — | — | 1.2 | 0 | 1-2 | 660 |
| | NC6 | Balance | 17.5 | 2.3 | 17.5 | 17.5 | — | — | 1.2 | 0 | 1-1.5 | 640 |
| | NC7 | Balance | 20.0 | 2.3 | 30.0 | 30.0 | — | — | 1.2 | 0 | 0.1-0.3 | 380 |
| | NC8 | Balance | 5.5 | 2.3 | 5.5 | 4.5 | — | — | 1.2 | 0 | 2-4 | 720 |
| | NC9 | Balance | 5.0 | 2.3 | 3.0 | 3.0 | — | — | 1.2 | 0 | 3-4 | 660 |
| | NC10 | Balance | 18.0 | 2.3 | 8.0 | 8.0 | — | — | 1.2 | 0 | 1-1.5 | 620 |

TABLE 11

| | | Composition of Hafnium-and-Hafnium Carbide Containing Build-up Wear-resistant Copper-based Alloy Weight % | | | | | | | | Cracking Occurrence | Wear Weight Valve Seat | Machinability |
|---|---|---|---|---|---|---|---|---|---|---|---|---|
| | Sample | Cu | Ni | Si | Hf | Mn | Fe | Co | HfC | Rate % | mg | Units |
| Example No. 11 | HC1 | Balance | 17.5 | 2.3 | 17.5 | 17.5 | — | — | 1.2 | 0 | 1-1.5 | 640 |
| | HC2 | Balance | 20.0 | 2.3 | 30.0 | 30.0 | — | — | 1.2 | 0 | 0.4-0.5 | 380 |
| | HC3 | Balance | 5.5 | 2.3 | 5.5 | 4.5 | — | — | 1.2 | 0 | 3-5 | 740 |
| | HC4 | Balance | 5.0 | 2.3 | 3.0 | 3.0 | — | — | 1.2 | 0 | 3-6 | 720 |
| | HC5 | Balance | 18.0 | 2.3 | 8.0 | 10.0 | — | — | 1.2 | 0 | 1-2 | 640 |
| | HC6 | Balance | 17.5 | 2.3 | 17.5 | 17.5 | — | — | 1.2 | 0 | 1-1.5 | 620 |
| | HC7 | Balance | 20.0 | 2.3 | 30.0 | 30.0 | — | — | 1.2 | 0 | 0.1-0.2 | 360 |
| | HC8 | Balance | 5.5 | 2.3 | 5.5 | 4.5 | — | — | 1.2 | 0 | 2-3 | 680 |
| | HC9 | Balance | 5.0 | 2.3 | 3.0 | 3.0 | — | — | 1.2 | 0 | 2-4 | 640 |
| | HC10 | Balance | 18.0 | 2.3 | 8.0 | 8.0 | — | — | 1.2 | 0 | 0.5-1 | 600 |

Microscopic Observation

When observing the microscopic structure of the built-up layer, which was formed of aforementioned Sample "A5" equivalent to the present-invention material, a large number of hard particles having hard phases were dispersed in the entire matrices of the built-up layer. The particle diameters of the hard particles were 10-100 μm approximately. When examining the aforementioned structure using an EPMA analyzing apparatus, the hard particles were formed of silicide whose major component was tantalum, and Ni—Fe—Cr system solid solution, as the major ingredients. The matrices, which constituted the built-up layer, were formed of Cu—Ni system solid solution, and network-shaped silicide whose major component was nickel, as the major ingredients. Moreover, the hardness (micro Vickers hardness) of the matrices of the built-up layers was Hv 150-200 approximately, and the average hardness of the hard particles was harder than the average hardness of the matrices and was Hv 300-500 approximately. The volumetric ratio of the hard particles fell within 5-60% of 100% when the build-up wear-resistant copper-based alloy was taken as 100%.

Note that it is believed that the build-up wear-resistant copper-based alloys according to the present example are such that the liquid-phase separation tendency is high in molten liquid state; a plural kinds of liquid phases, which are less likely to mix with each other, are likely to generate; and the separated phases are provided with properties, which are likely to separate up and down, by means of the respective specific-weight differences, heat-transmission circumstances, and the like. In this case, it is believed that, when the liquid phases, which are turned into being particulate, are solidified rapidly, the particulate liquid phases generate the hard particles.

Further, when observing the microscopic structure of the built-up layer, which was formed of the copper-based alloy being provided with the composition of Sample "A5" including the aforementioned carbide (tantalum carbide, TiC), as well, a large number of hard particles having hard phases were dispersed in the entire matrices of the built-up layer. The particle diameters of the hard particles were 10-100 μm approximately. When examining the aforementioned structure using an EPMA analyzing apparatus, similarly to the above description, the hard particles were formed of silicide whose major component was tantalum, and Ni—Fe—Cr system solid solution, as the major ingredients. It was confirmed by the present inventors, and the like, using an X-ray diffraction analyzing apparatus that the silicide, which constitutes the aforementioned hard particles, is a Laves phase.

Figure 3:
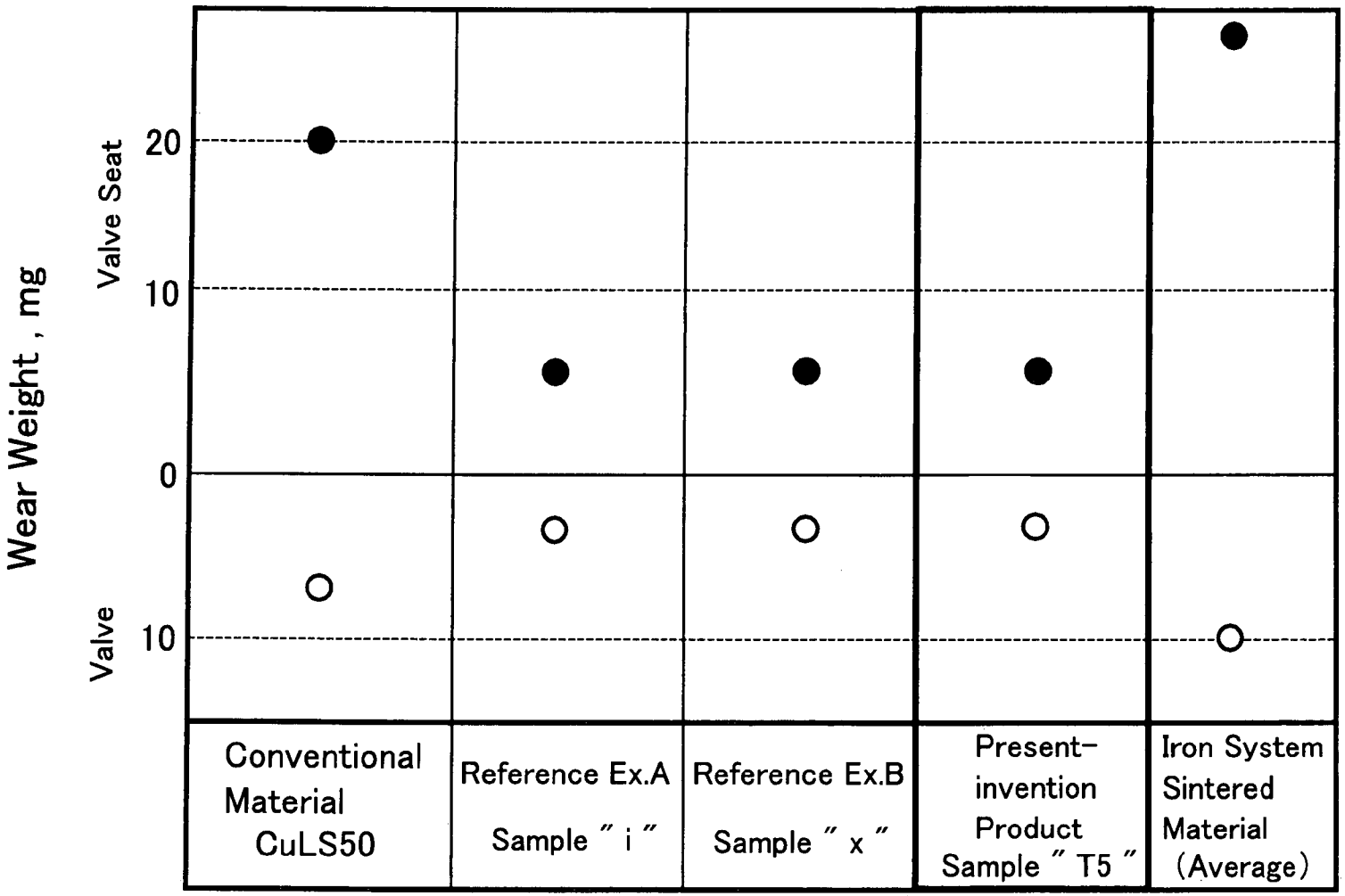
FIG. 3 is a graph for illustrating the wear weights of the built-up layers of a present-invention material, reference examples, etc.

FIG. 3, in the case of being applied to a valve seat, illustrates test results regarding the wear weights of selves (valve seats), being built-up layers, and the wear weights of a mating member (valve). Reference Example "A" shown in FIG. 3 is based on a built-up layer, which was formed by building up the build-up wear-resistant copper-based alloy, which had the composition of Sample "i" set forth in Table 1, with a laser beam. Reference Example "B" shown in FIG. 3 is based on a built-up layer, which was formed by building up the build-up wear-resistant copper-based alloy, which was formed of Sample "x" which was provided with the composition containing NbC in an amount of 1.2% and was set forth in Table 1, with a laser beam. In the present description, as described above, % designates weight % unless otherwise specified particularly.

As for a cobalt-rich conventional material (type: CuLs50), a built-up layer was formed by means of a laser beam with an alloy, in which Ni was 15%, Si was 2.9%, Co was 7%, Mo was 6.3%, Fe was 4.5%, Cr was 1.5% and the balance was Cu practically, and the wear test was carried out similarly.

As for a comparative example, a test piece was formed with an iron system sintered material (composition: Fe: balance, C: 0.25-0.55%, Ni: 5.0-6.5%, Mo: 5.0-8.0%, and Cr: 5.0-6.5%), and the wear test was carried out similarly.

As illustrated in FIG. 3, in accordance with the present-invention material (equivalent to Sample "T5"), the wear amount of the build-up wear-resistant copper-based alloy (valve seat), being the self, was less, and the wear amount of the mating member (valve) was less as well, similarly to the cases of Reference Examples "A" and "B." On the other hand, in the case of the conventional material and in the case of the iron system sintered material, the self (valve seat) wear amount was great, and the wear amount of the mating member (valve) was great as well.

Further, using alloys whose compositions were adjusted so as to be a high wear-resistant-component blend as well as a low wear-resistant-component blend with respect to the aforementioned conventional material (type: CuLS50), built-up layers, which were turned into valve seats, were formed individually by means of irradiating sample layers, which were formed of these alloys, with a laser beam, the cracking occurrence rates in the built-up layers were tested. Here, the high wear-resistant-component blend means a blended composition which aims at the increment of the hard-phase proportion in the hard particles, which are generated during building up. The low wear-resistant-component blend means a blended composition which aims at the decrement of the hard-phase proportion in the hard particles, which are generated during building up. Similarly, with respect to Reference Example No. 1 and Reference Example No. 2, the compositions were adjusted so as to be a high wear-resistant-component blend as well as a low wear-resistant-component blend, respectively, and the test was carried out. Similarly, with respect to the present-invention material as well, the composition was adjusted so as to be a high wear-resistant-component blend as well as a low wear-resistant-component blend, and the test was carried out.

Here, the composition, which was a high wear-resistant-component blend with respect to the conventional material, is Cu: balance, Ni: 20.0%, Si: 2.90%, Mo: 9.30%, Fe: 5.00%, Cr: 1.50%, and Co: 6.30%. The composition, which was a low wear-resistant-component blend with respect to the conventional material, is Cu: balance, Ni: 16.0%, Si: 2.95%, Mo: 6.00%, Fe: 5.00%, Cr: 1.50%, and Co: 7.50%. The composition, which was a high wear-resistant-component blend with respect to Reference Example No. 1, is Cu: balance, Ni: 17.5%, Si: 2.3%, Mo: 17.5%, Fe: 17.5%, Cr: 1.5%, and Co: 1.0%. The composition, which was a low wear-resistant-component blend with respect to Reference Example No. 1, is Cu: balance, Ni: 5.5%, Si: 2.3%, Mo: 5.5%, Fe: 4.5%, Cr: 1.5%, and Co: 1.0%.

The composition, which was a high wear-resistant-component blend with respect to Reference Example No. 2, is Cu: balance, Ni: 17.5%, Si: 2.3%, Mo: 17.5%, Fe: 17.5%, Cr: 1.5%, Co: 1.0%, and NbC: 1.2%. The composition, which was a low wear-resistant-component blend with respect to Reference Example No. 2, is Cu: balance, Ni: 5.5%, Si: 2.3%, Mo: 5.5%, Fe: 4.5%, Cr: 1.5%, Co: 1.0%, NbC: 1.2%.

Moreover, the composition, which was a high wear-resistant-component blend with respect to the present-invention material, is Cu: balance, Ni: 17.5%, Si: 2.3%, W: 17.5%, Fe: 17.5%, Cr: 1.5%, Co: 1.0%, and WC: 1.2%. The composition, which was a low wear-resistant-component blend with respect to the present-invention material, is Cu: balance, Ni: 5.5%, Si: 2.3%, W: 5.5%, Fe: 4.5%, Cr: 1.5%, Co: 1.0%, and WC: 1.2%.

Figure 4:
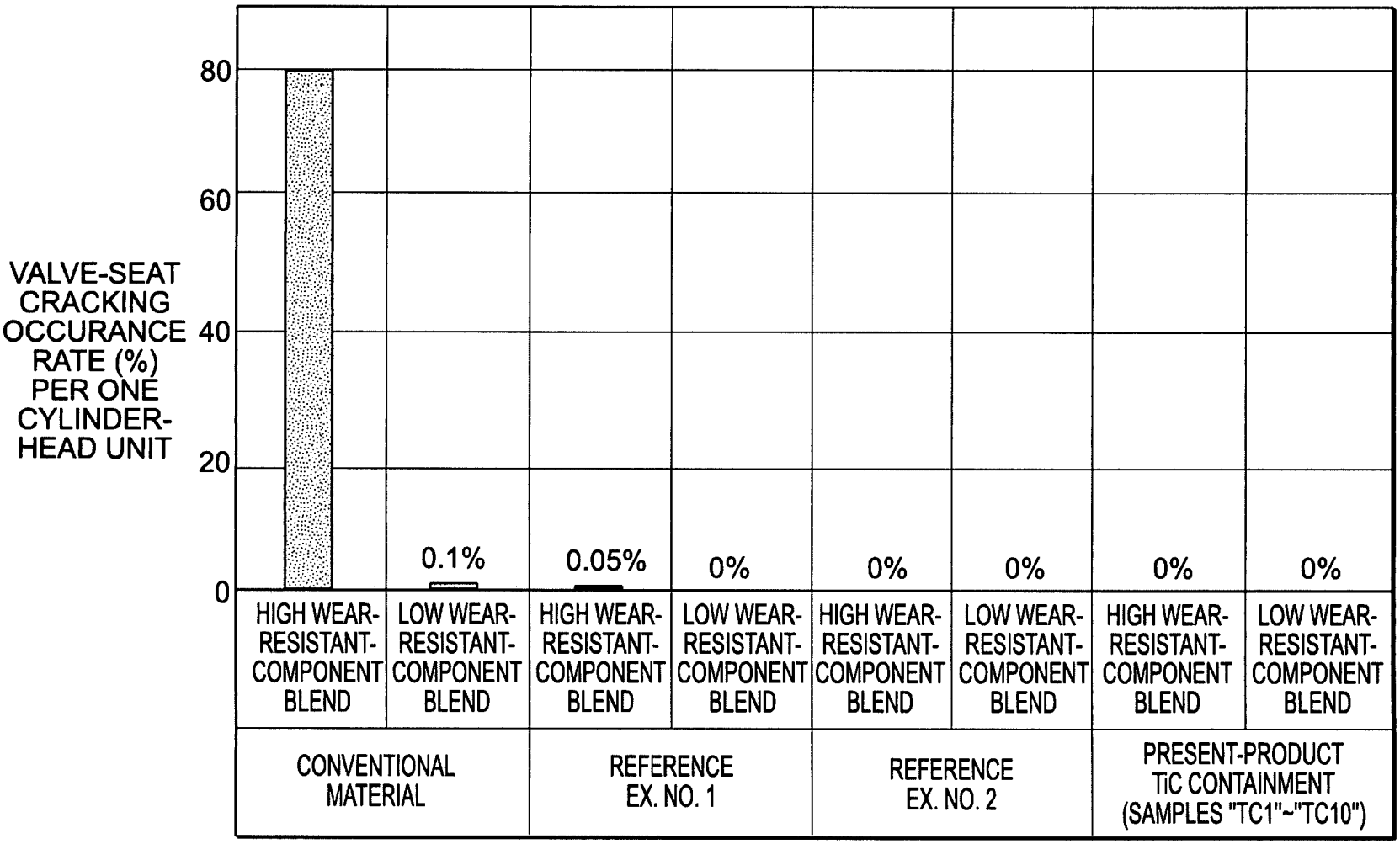
FIG. 4 is a graph for illustrating the valve-seat cracking occurrence rates per one cylinder-head unit with regard to the built-up layers of a present-invention material, reference example, etc.

The test results of the cracking occurrence rate is illustrated in FIG. 4. As shown in FIG. 4, regarding the test piece, in which the high wear-resistant-component blend according to the conventional material was done, the cracking occurrence rate was extremely high. On the other hand, regarding Reference Example No. 1, with regard to the built-up layers in which the high wear-resistant-component blend and low wear-resistant-component blend were done, the cracking occurrence rate was 0%, and was extremely low. Regarding Reference Example No. 2 as well, with regard to the built-up layers in which the high wear-resistant-component blend and low wear-resistant-component blend were done, the cracking occurrence rate was 0%, and was extremely low. Regarding the present-invention material (equivalent to Samples "TC1"-"TC10") as well, with regard to the built-up layers in which the high wear-resistant-component blend and low wear-resistant-component blend were done, the cracking occurrence rate was 0%, and was extremely low.

Further, with respect to the aforementioned conventional material, Reference Example No. 1, Reference Example No. 2 and present-invention material, alloys whose composition was adjusted so as to be a high wear-resistant-component blend as well as a low wear-resistant-component blend were used; built-up layers, which were turned into valve seats, were formed on a cylinder head by means of irradiating sample layers, which were formed of the respective alloys, with a laser beam; and thereafter the built-up layers were cut with a machining cutting tool (cemented carbide cutting bit), thereby examining the number of processed cylinder-head units, which were cuttable per one-piece machining cutting tool. The test results are illustrated in FIG. 5.

Figure 5:
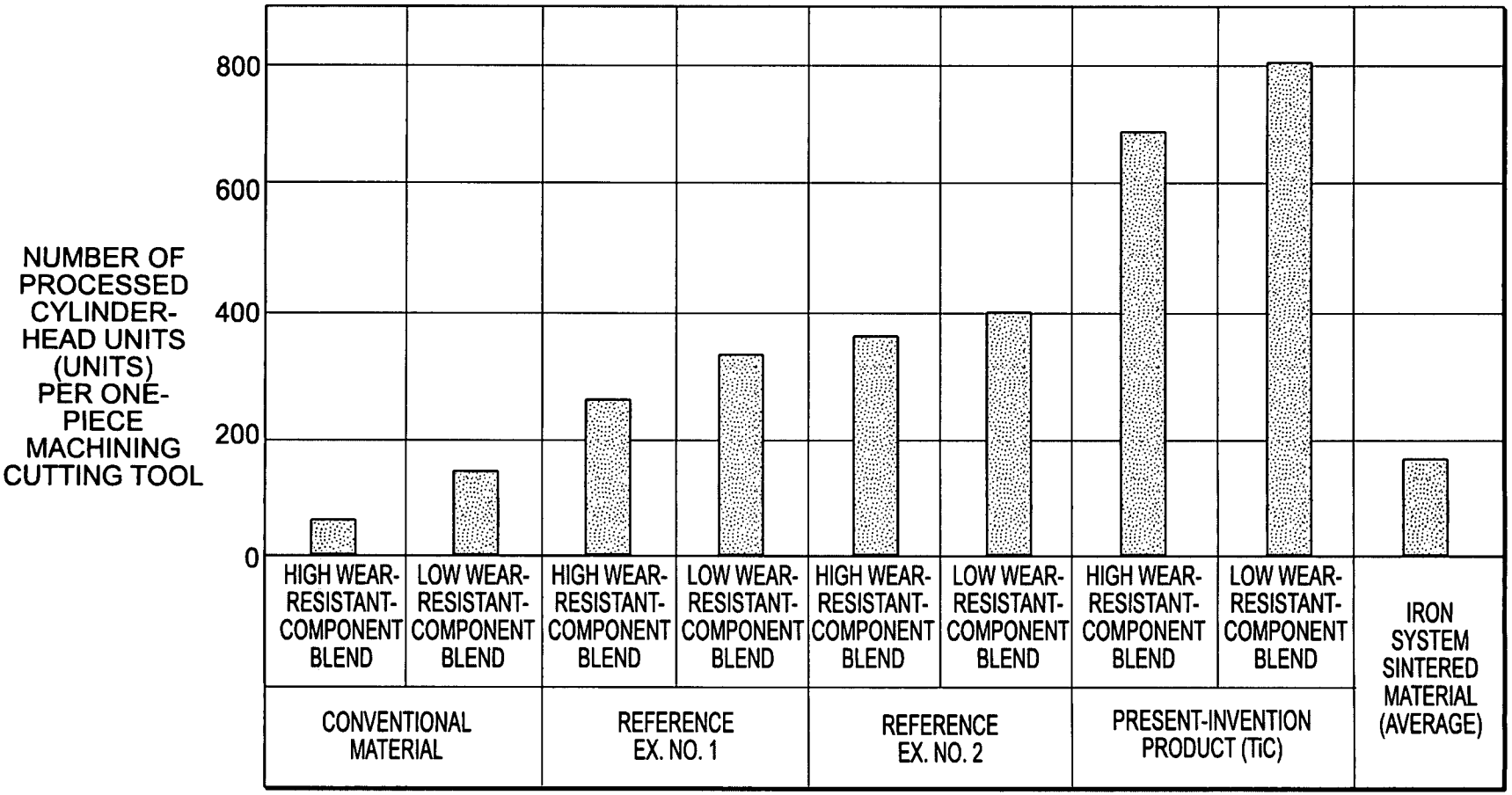
FIG. 5 is a graph for illustrating the number of processed cylinder-head units per one-piece machining cutting tool with regard to the built-up layers of a present-invention material, reference examples, etc.

As shown in FIG. 5, regarding the conventional material, both of the test pieces, in which the high wear-resistant-component blend as well as the low wear-resistant-component blend were done, are such that the number of the processed cylinder-head units per one-piece machining cutting tool was less so that the machinability was low.

On the other hand, regarding the test piece in which the high wear-resistant-component blend according to Reference Example No. 1 was done, the test piece in which the low wear-resistant-component blend according to Reference Example No. 1 was done, the test piece in which the high wear-resistant-component blend according to Reference Example No. 2 was done, and the test piece in which the low wear-resistant-component blend according to Reference Example No. 2 was done, the number of the processed cylinder-head units per one-piece machining cutting tool was considerably great so that the machinability was satisfactory.

Regarding the test piece in which the high wear-resistant-component blend according to the present-invention material was done, as shown in FIG. 5, and the test piece in which the low wear-resistant-component blend according to the present-invention material was done, the number of the processed cylinder-head units per one-piece machining cutting tool was 600-800 units, and was considerably great so that the machinability was better than Reference Example Nos. 1 and 2. When the machinability was tested similarly regarding the aforementioned iron system sintered material as well, the number of the processed cylinder-head units per one-piece machining cutting tool was 180 units approximately, and was less so that the machinability was low.

Let us evaluate the aforementioned test results comprehensively, when a valve seat per se, which is a dynamic-valve-system component part for an internal combustion engine, is formed of the built-up layer of the build-up wear-resistant copper-based alloy according to the present invention, or when the built-up layer of the build-up wear-resistant copper-based alloy according to the present invention is laminated onto a vale seat, it is understood that the wear resistance of the valve seat can be improved; further the mating-member aggressiveness can be suppressed; and the wear amount of a valve, which is the mating member, can be suppressed as well. Further, it is advantageous to enhance the cracking resistance as well as the machinability, and especially it is advantageous in the case of forming built-up layers by building it up.

Applicable Example

Figure 6:
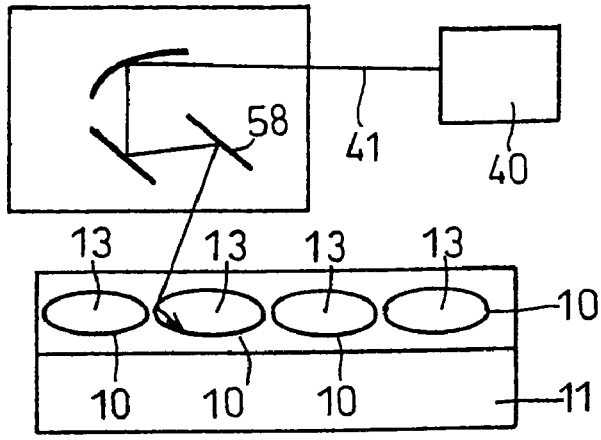
FIG. 6 relates to an application example, and is an outline diagram for illustrating the processes of forming valve seats on the ports of an internal combustion engine by building up a build-up wear-resistant copper-based alloy.
Figure 7:
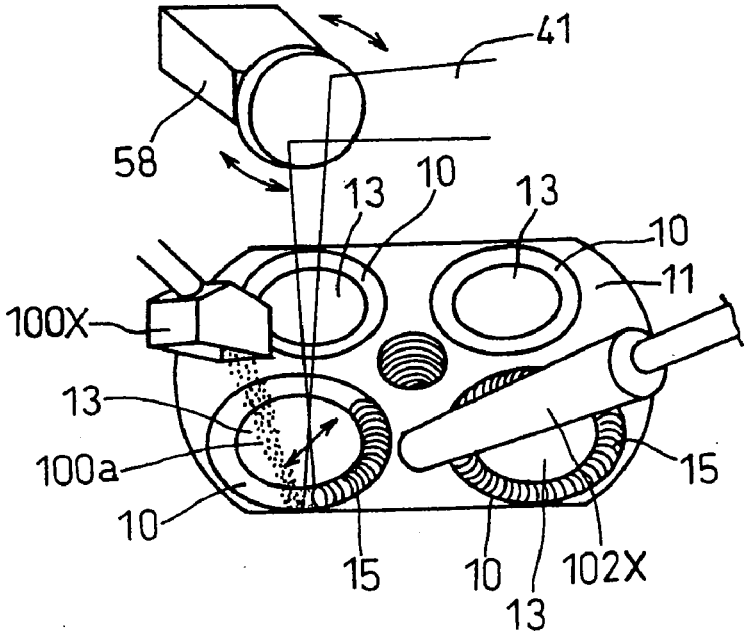
FIG. 7 relates to an application example, and is a perspective diagram for illustrating the processes of forming valve seats on the ports of an internal combustion engine by building up a build-up wear-resistant copper-based alloy.

FIG. 6 and FIG. 7 illustrate an applicable example. In this case, valve seats are formed onto ports 13, which communicate with combustion chambers of an internal combustion engine 11 for vehicles, by building up the build-up wear-resistant copper-based alloy. In this case, on the inner peripheral portion of a plurality of the ports 13, which communicate with the combustion chambers of the internal combustion engine 11 formed of an aluminum alloy, a rim surface 10, which is formed as a ring shape, is disposed. In such a state that a diffuser 100X is moved closer to the rim surface 10, a powder layer is formed by depositing a powder 100*a*, which comprises the build-up wear-resistant copper-based alloy according to the present invention, onto the rim surface 10, and additionally a built-up layer 15 is formed on the rim surface 10 by means of irradiating the powder layer with a laser beam 41, which is oscillated from a laser oscillator 40 while swinging the laser beam 41 by means of a beam oscillator 58. This built-up layer 15 becomes a valve seat. In the course of building it up, a shield gas (in general, an argon gas) is supplied to building-up locations from a gas supplying apparatus 102X, thereby shielding the building-up locations.

Others

In the aforementioned examples, a powder of the build-up wear-resistant copper-based alloys were formed by means of a gas-atomizing treatment, however, not limited to this, it is advisable to form a building-up powders of the build-up wear-resistant copper-based alloys by means of a powdering treatment, such as a mechanical atomizing treatment in which a molten metal is collided with a rotary body to powder it, or a mechanical pulverizing treatment using a pulverizing apparatus.

The aforementioned examples are the cases of applying them to a valve seat, which constitutes the dynamic valve system of internal combustion engines, however, they are not limited to this. Depending on cases, they can be applied to materials for constituting valves, which are the mating member of the valve seat, or alternatively to materials, which are to be built up onto the valves. The internal combustion engines can be either gasoline engines, or diesel engines. The aforementioned examples are applied to the cases of building up, however, they, not limited to this, can be applied to ingot products, sintered products, and the like, depending on cases.

In addition, the present invention is not limited to those mentioned above and the examples shown in the drawings alone, but can be carried out within ranges, which do not depart from the gist, while making changes properly. The embodying modes and the wording or phrasal expressions set forth in the examples, even a part thereof, can be set forth in the respective claims. Note that the numerals of the contents of the compositional components set forth in Table 1-Table 1 can be defined as the upper limit values or lower limit values of the compositional components of the claims or additional terms.

It is possible to grasp the following technical ideas as well from the aforementioned descriptions.

(Additional Term No. 1) A built-up layer being formed of one of the build-up wear-resistant copper-based alloys according to the respective claims.

(Additional Term No. 2) A built-up sliding member being formed of one of the build-up wear-resistant copper-based alloys according to the respective claims.

(Additional Term No. 3) In additional term No. 1 or additional term No. 2, the built-up layer or built-up sliding member being formed by means of a high-density energy heat source selected from laser beams, electron beams and arcs.

(Additional Term No. 4) A dynamic-valve-system member (for example, a valve seat) for internal combustion engines, the dynamic-valve-system member having a built-up layer being formed of one of the build-up wear-resistant copper-based alloys according to the respective claims.

(Additional Term No. 5) A production method for a sliding member being characterized in that a substrate is covered with a build-up wear-resistant copper-based alloy using one of the build-up wear-resistant copper-based alloys according to the respective claims.

(Additional Term No. 6) A production method for a sliding member being characterized in that a powder layer is formed by covering a substrate with a powder material using a powder material of one of the build-up wear-resistant copper-based alloys according to the respective claims; and turning the powder material into a molten metal and thereafter solidifying it, thereby forming a built-up layer being of good wear resistant.

(Additional Term No. 7) In additional term No. 6, the production method for a sliding member being characterized in that the built-up layer is formed by means of rapid heating and rapid quenching.

(Additional Term No. 8) In additional term No. 6, the production method for a sliding member being characterized in that the turning of the powder layer into a molten metal is carried out by means of a high-density energy heat source selected from laser beams, electron beams and arcs.

(Additional Term No. 9) In additional term No. 5or additional term No. 6, the production method for a sliding member being characterized in that the substrate is formed of aluminum or an aluminum alloy.

(Additional Term No. 10) In additional term No. 5or additional term No. 6, the production method for a sliding member being characterized in that the substrate is a dynamic-valve-system component part for internal combustion engines or a dynamic-valve-system part (for example, a valve seat).

(Additional Term No. 11) A valve-seat alloy being formed of one of the build-up wear-resistant copper-based alloys according to the respective claims.

(Additional Term No. 12) A build-up wear-resistant copper-based alloy, set forth in one of the respective claims, being characterized in that the hard particles are dispersed in the matrix; the hard particles are such that silicide and an Ni—Fe—Cr system solid solution are adapted to be the major ingredients; and the matrix is such that a Cu—Ni system solid solution and silicide, whose major component is nickel, are adapted to be the major ingredients.

(Additional Term No. 13) A powder material being formed of one of the build-up wear-resistant copper-based alloys according to the respective claims.

(Additional Term No. 14) A powder material for building up, the powder material being formed of one of the build-up wear-resistant copper-based alloys according to the respective claims.

(Additional Term No. 15) A sliding member being characterized in that a built-up layer, being formed of one of the build-up wear-resistant copper-based alloys set forth in the respective claims, is laminated on a substrate.

(Additional Term No. 16) A sliding member being characterized in that a built-up layer, being formed of one of the build-up wear-resistant copper-based alloys set forth in the respective claims, is laminated on a substrate whose base material is aluminum or an aluminum alloy.

INDUSTRIAL APPLICABILITY

As described above, the build-up wear-resistant copper-based alloy according to the present invention can be applied to copper-based alloys, which constitute the sliding sections of sliding members being represented by dynamic-valve-system members, such as the valve seats and valves of internal combustion engines, for instance.

The invention claimed is:

1. A build-up wear-resistant copper-based alloy, consisting of:

nickel in an amount ranging from 5.0 to 20.0% by weight;

silicon in an amount ranging from 0.5 to 5.0% by weight;

manganese in an amount ranging from 3.0 to 30.0% by weight;

an element combined with said manganese to form a Laves phase and to form a silicide in an amount ranging from 3.0 to 30.0% by weight; and a balance containing copper and impurities, wherein said element combined with the manganese to form a Laves phase and to form a silicide is at least one selected from the group consisting of titanium (Ti), hafnium (Hf), zirconium (Zr), and a mixture thereof.

2. The build-up wear-resistant copper-based alloy according to claim 1, wherein said silicide is dispersed.

3. The build-up wear-resistant copper-based alloy according to claim 1, defining a matrix and hard particles dispersed in said matrix, wherein an average hardness of said matrix is Hv 130-260; and wherein an average hardness of said hard particles is harder than that of said matrix.

4. The build-up wear-resistant alloy according to claim 1, defining a matrix and hard particles dispersed in said matrix, wherein the major ingredients of the matrix are a Cu—Ni system solid solution and a silicide whose major component is nickel.

5. The build-up wear-resistant copper-based alloy according to claim 1, wherein said alloy is used as an alloy for building up, said alloy being solidified after melted by a high-density energy beam.

6. The build-up wear-resistant copper-based alloy according to claim 1, constituting a built-up layer, said built-up layer being coated onto a substrate.

7. The build-up wear-resistant copper-based alloy according to claim 1, wherein said alloy is used in sliding members.

8. The build-up wear-resistant copper-based alloy according to claim 1, wherein said alloy is used in dynamic-valve-system members for internal combustion engines.

9. A build-up wear-resistant copper-based alloy, consisting of:

nickel in an amount ranging from 5.0 to 20.0% by weight;

silicon in an amount ranging from 0.5 to 5.0% by weight;

manganese in an amount ranging from 3.0 to 30.0% by weight;

an element combined with said manganese to form a Laves phase and to form a silicide in an amount ranging from 3.0 to 30.0% by weight, wherein said element is at least one selected from the group consisting of titanium, hafnium, zirconium, and a mixture thereof;

a carbide selected from the group consisting of titanium carbide, tungsten carbide, chromium carbide, vanadium carbide, tantalum carbide, niobium carbide, zirconium carbide, hafnium carbide, and a mixture thereof in an amount ranging from 0.01 to 10% by weight; and a balance containing copper and impurities.

* * * * *